US008202497B2

(12) United States Patent
Nakahana et al.

(10) Patent No.: US 8,202,497 B2
(45) Date of Patent: Jun. 19, 2012

(54) LID ELEMENT ARRAY AND A MICRO TUBE ARRAY FOR SAMPLE STORAGE INCLUDING THE SAME

(76) Inventors: Yoko Nakahana, Hyogo (JP); Shinichiro Kakuda, Hyogo (JP)

( * ) Notice: Subject to any disclaimer, the term of this patent is extended or adjusted under 35 U.S.C. 154(b) by 0 days.

(21) Appl. No.: 12/745,126

(22) PCT Filed: Jun. 25, 2009

(86) PCT No.: PCT/JP2009/062077

§ 371 (c)(1),
(2), (4) Date: Aug. 27, 2010

(87) PCT Pub. No.: WO2010/150415

PCT Pub. Date: Dec. 29, 2010

(65) Prior Publication Data

US 2012/0087848 A1 Apr. 12, 2012

(51) Int. Cl.
*B01L 99/00* (2010.01)

(52) U.S. Cl. ..... 422/569; 428/98; 435/305.3

(58) Field of Classification Search ..... 422/569
See application file for complete search history.

(56) References Cited

U.S. PATENT DOCUMENTS

| | | | | |
|---|---|---|---|---|
| 5,282,543 | A * | 2/1994 | Picozza et al. | 220/255 |
| 6,776,964 | B1 | 8/2004 | Wijnschenk et al. | |
| 6,890,488 | B2 * | 5/2005 | Mathus et al. | 422/569 |
| 6,939,512 | B2 * | 9/2005 | Lihl et al. | 422/67 |
| 6,972,112 | B1 * | 12/2005 | Reo | 422/558 |
| 7,166,258 | B2 * | 1/2007 | Bass et al. | 422/552 |
| 2002/0187077 | A1 * | 12/2002 | Berray et al. | 422/99 |
| 2004/0237673 | A1 * | 12/2004 | Zwick et al. | 73/863.31 |

FOREIGN PATENT DOCUMENTS

| | | |
|---|---|---|
| JP | 2003-279586 | 10/2003 |
| JP | 2005-003426 | 1/2005 |
| JP | 2007-197054 | 8/2007 |

* cited by examiner

*Primary Examiner* — In Suk Bullock
*Assistant Examiner* — Timothy G Kingan
(74) *Attorney, Agent, or Firm* — Hamre, Schumann, Mueller & Larson, P.C.

(57) ABSTRACT

A lid element array and a micro tube array set for sealing the opening of each micro tube in an array quickly at low cost. A lid element array 100 comprises a lid element sheet 120 comprising a plurality of lid element 121 arrayed corresponding to the number and the arrangement of a plurality of said micro tubes 210; a release sheet 140; a first adhesive 110 applied to each said lid element in said lid element sheet 120; a second adhesive 130 applied between said lid element sheet 120 and said release sheet 140; wherein, each said lid element in said lid element sheet is supported by said release sheet with a cut-line cut around the edge of each said lid element for separation from said lid element sheet, each said lid element moves to a corresponding opening of each said micro tube and seals the same by pressing said lid element to the surface of said micro tube array for facing the surface applied with said first adhesive and the surface of said micro tube array. A convex portion is installed on the surface of the lid element 121, and said convex portion works as a positioning guide for the lid element array 100.

13 Claims, 16 Drawing Sheets

LID ELEMENT ARRAY AND A MICRO TUBE ARRAY FOR SAMPLE STORAGE INCLUDING THE SAME

TECHNICAL FIELD

This invention relates to a lid element array for enclosing the top opening of a micro tube array for storing and containing many samples and a micro tube array including the same. For example, the micro tube array is used in enclosing and storing developing medicine samples. Also, it is used for storing samples that hold gene information of DNA in the medical field.

BACKGROUND ART

In the research and development of medicine and chemicals, storage tubes are used extensively in storing a large number of samples. For example, scientists prepare a large number of samples for a comparative experiment with slightly changing conditions such as blending amount, and they use storage tubes for storing the samples for a required period of time while handling them.

In order to control and store a large number of storage tubes at a time as described above, there are two types of the sample storage systems known in the prior art.

The first type is a well-plate block type of the sample storage container. The well-plate block type of the sample storage container is a block type container, which is called a well-plate having a lot of wells in the solid plastic block. The well-plate block type of the sample storage container is called an assay block too. The well-plate block type of the sample storage container is made by providing a lot of wells in the plastic block, the well having an inner wall shape corresponding to that of the test tube. The predetermined numbers of wells, for example 96 or 364 wells, are arrayed in the plastic block. When using such well-plate type of the sample storage container block, a lot of test samples can be arranged efficiently and stored by utilizing each well as a sample storage tube.

When using such well-plate type of the sample storage container block, the basic method for enclosing the top opening of the well is the method for enclosing the opening of all wells at the same time by sealing the lid sheet such as a sheet of aluminum plate and a sheet of plastic film onto the whole surface of the well-plate type of the sample storage block.

FIG. 15 is a schematic view showing the case covering the whole surface of the conventional well-plate type of the sample storage block by the lid sheet. FIG. 15 (*a*) shows the status when covering the whole surface of the conventional well-plate type of the sample storage block 10 by sealing the lid sheet 20, and FIG. 15 (*b*) shows the status when opening the whole surface of the conventional well-plate type of the sample storage block 10 by turning over the lid sheet 20 up from the edge. In these figures, a part of the structure of the inner well 11 is shown by the broken line for convenience. There are 96 pieces of wells 11 used as sample storages in the conventional well-plate type of the sample storage block 10. When covering the whole surface of the conventional well-plate type of the sample storage block 10, it is covered by one lid sheet 20, when opening up the whole surface of the opening of the wells, one lid sheet 20 is turned over by destroying the lid sheet 20.

Next, the second type is a micro tube array type arraying a lot of sample storage containers of the micro tube type in the storage rack. The micro tube array stores and contains each test sample in each small sample container called the micro tube piece by piece independently and arrayed in the storage rack. The micro tube is a container of about several centimeter height and made of plastic material. Each micro tube is an independent piece, and it is possible to use them as sample storage containers one by one. It is also possible to use as the micro tube array storing a lot of test samples at the same time by arraying a lot of micro tubes in the storage rack.

When using the micro tube array, each micro tube is an independent sample storage container, so each micro tube should be identified independently. In recent years sample storages that are controlled by printing a barcode or two-dimensional code on the side and/or bottom surface of the storage tube are highlighted, in which various data and/or control information of a sample are encoded.

The method for enclosing the top opening of the micro tube array is the method for enclosing the opening of each micro tube by the lid one by one by hand or by an expensive special lid closure machine. It is difficult for sealing the opening of the independent micro tube with one large sheet of the aluminum plate or one large sheet of plastic film, such as the lid sheet used for the well-plate type of the sample storage block, covering the whole surface of the micro tube array.

Most of the lids for the micro tube are the plastic stopper type lid pushed into the opening of the micro tube and which shape corresponds to that of the opening of the micro tube. Another type of the lid for the micro tube is the screw thread lid having an external thread on the external-surface of the lid. In this case, an internal thread is in the internal-surface of the top opening of the micro tube, and the screw thread lid is screwed into the top opening of the micro tube.

FIG. 16 is a schematic view showing the case enclosing the opening of each micro tube of the conventional micro tube array by each lid. FIG. 16 (*a*) shows the status when enclosing the opening of each micro tube 30 of the conventional micro tube array by each lid 32 arrayed in the storage rack 40, FIG. 16 (*b*) shows the status when taking one piece of micro tube 30 from the storage rack 40 and opening the top opening of the micro tube 31 by turning the lid 32 off. In these figures, a part of the structure of the micro tube 30 is shown by the broken line for convenience.

A plurality of the container spaces 41 are installed in the storage rack 40, and each micro tube 30 is arrayed in the container space 41. The opening of the micro tube 30 is covered by the lid 32. In this example, the screw thread is installed in both micro tube 30 and the lid, and the lid is screwed in the micro tube opening.

DISCLOSURE OF THE INVENTION

The Problems to be Solved

The above conventional well-plate type of the sample storage block type in the prior art can store the test samples by sealing the well opening by the lid sheet 20 at the same time, and the conventional micro tube array type of the sample storage in the prior art can store the test samples by enclosing the micro tube opening with the lid 32 independently.

However, with the above conventional well-plate type of the sample storage block type in the prior art there remains a matter to be improved as follows.

The first problem is that it is difficult for utilizing the space of the refrigerator effectively because the volume of the sample storage tube block 10 is fixed.

The storing conditions of the test samples vary. A constant temperature, especially, the cold temperature provided by the special refrigerating unit colder than the temperature that can be provided by the general refrigerator often is required for the test samples storing condition. Such a special refrigerating unit is expensive, so the limited storing space should be utilized effectively. The conventional well-plate type of the sample storage block in the prior art occupies the fixed volume in the space of the refrigerator regardless of the number of the stored test samples. For example, the whole well-plate type of the sample storage block 10 should be stored in the space even if the test samples are stored in half of all the wells 11. In this case, half space is not utilized and it is difficult for utilizing the whole space effectively. As shown above, the volume of the well-plate type of the sample storage block 10 is fixed, it is difficult for utilizing the whole space of the refrigerator effectively.

The second problem is that the partial use of the sample storage tube block 10 is difficult, so effectively utilizing the sample storage tube block 10 becomes difficult.

The lid of the sample storage tube block 10 is one sheet of the seal 20, the opening of the lid is destructive opening, so there is a problem that the whole surface should be opened even if only small numbers of wells are opened. Especially, the test sample to be used for the test is stored in the wells 11 in the center part of the sample storage tube block 10, not in the edge part of the sample storage tube block 10, it is difficult to take the test samples out by making holes in the lid sheet 20. Therefore, the method for opening the lid sheet 20 is wholly destructive opening, and if only a few wells 11 are to be opened, the lid sheet 20 should be opened by breaking all of the lid sheet 20, and the whole surface of the sample storage tube block 10 should be sealed by a new lid sheet 20 in order to seal the well 11 for sealing the rest samples.

Next, with the above conventional micro tube array type in the prior art there remains a matter to be improved as follows.

The first problem is that if the work for enclosing the lid 32 into the micro tube becomes a hand operation, the enclosing operation of the top opening of the micro tube 30 requires human hand operation. When many test samples are stored by the micro tube array, each top opening of the micro tube 30 should be covered by the lid 32 one by one by human hand operation, it will become very troublesome.

The second problem is that the expensive special lid closure machine is required if the enclosing operation is automated, and a significant cost will be required for developing such special lid closure machine.

There are various types of automation machines. First, there is the automation machine for installing each lid to each micro tube independently. There is a margin in order to install the lid 32 to the micro tube 30, and there will be an error in status of the micro tube 30 in the storage rack 40 because each micro tube 30 is independent. The error in status of the micro tube 30 in the storage rack 40 is larger than the margin between the opening of the micro tube 30 and the lid 32, when installing each lid to each micro tube by the automation machine, and the automation machine should detect the status of the micro tube 30 and provide the status control method for adjusting the status of the micro tube 30 in order to decrease the error in status within the margin for installing the lid 32. Therefore, much cost will be required for developing such a mechanism for the automation machine.

Another automation machine is for sealing a lid sheet 20 to all micro tubes at the same time and for cutting and separating the lid sheet 20 for each micro tube 30. One of the merits of the micro tube array is that each micro tube 30 can be handled independently, so if the whole surface of the micro tube array is sealed by one large lid sheet 20, the lid sheet 20 should be cut and divided into pieces corresponding to each micro tube 30. However, as described above, each micro tube 30 is installed into the storage rack 40 in various states, so it is difficult to cut the lid sheet 20 to each piece corresponding to each micro tube 30. In addition, every top opening of all micro tube 30 should be sealed safely, and if there is a cut hole in the lid of any micro tube 30 when the cutter cuts the lid sheet, the air-tightness of the micro tube 30 is not secured. Moreover, what is called a "burr" is generated on the cut edge, the operation for eliminating the burr is required. As shown above, an automation machine having the mechanism for cutting the lid sheet precisely with securing the air-tightness of the micro tube 30 and the mechanism for eliminating burr generated on the cut edge of the lid sheet, so a big cost is required for developing such automation machine.

It is an object of the present invention to provide a useful sample storage container of the micro tube array type that has many advances for a test sample storage container, the top opening of each micro tube array being sealed independently with low cost and short time.

Means for Solving the Problems

In order to achieve the above-mentioned object, the present invention of a lid element array including a plurality of lid elements for sealing the opening of a plurality of micro tubes comprises;

a lid element sheet wherein a plurality of said lid elements are arrayed corresponding to the number and the arrangement of a plurality of said micro tubes arrayed in said micro tube array;

a release sheet for supporting said lid element sheet from bottom side;

a first adhesive applied at least to a predetermined area of said each lid element in said lid element sheet;

a second adhesive applied between said lid element sheet and said release sheet; wherein, each said lid element in said lid element sheet is supported by said release sheet with a cut-line cut around the edge of each said lid element for separation from said lid element sheet, said each lid element moves to a corresponding opening of each said micro tube and seals the same by pressing said lid element to the surface of said micro tube array for facing the surface applied said first adhesive and the surface of said micro tube array.

According to the above-mentioned configuration of the first invention of the lid element array, the opening of the micro tube arrayed in the micro tube array can be sealed firmly by a simple method that is difficult in a prior art.

The lid element 121 is what is called a sticker having a half-cut-off line around the edge, and the lid element is moved to the micro tube array side from the lid element array by pressing the lid element array to the micro tube array, each opening of the micro tube being sealed by each lid element bound by the first adhesive.

The positioning of the lid element array and the micro tube array is required in order to move the lid element precisely. In the present invention, a part or all lid element comprise a convex portion on the surface, the convex portion works as a positioning guide for each lid element and each micro tube by inserting the convex portion to the corresponding opening of the micro tube when pressing the lid element array to the micro tube array. For example, when all lid elements comprise the convex portion on the surface (for example, the object fits to the shape of the opening of the micro tube smoothly), precise positioning can be conducted by utilizing the convex portion as the positioning guide for searching the position where the convex portion fits into the opening of the micro tube before the final positioning decision. There is no need to install the convex portion to all lid elements. At least 2 pieces of lid elements (for example, the upper right and the lower left), preferably 4 pieces of lid elements (for example, four corners) are required.

Moreover, there is no need to install the positioning guide to the lid element in order to gain the positioning guide function for positioning each lid element and each micro tube.

If the lid element sheet comprises a fitting object fit to the shape of the micro tube array on the surface except for the area of the lid element, the fitting object works as a positioning guide for each lid element and each micro tube by fitting the fitting object and the shape of the micro tube when pressing the lid element array to the micro tube array.

For example, the convex portion fitting the outer edge of the micro tube array is installed to the edge part of the lid element sheet, and the convex portion works as the positioning guide by fitting the convex portion to the outer edge of the micro tube array when pressing the lid element array to the micro tube array.

If the convex portions are installed to all lid elements, other merits can be obtained besides the merit of the positioning guide for each lid element and each micro tube as shown below.

The first merit is the merit that the convex portions work as heat absorbers and shock absorbers.

For example, when the convex portions on the lid element are made by an embossing process and there are spaces between the lid element and the release sheet, the air in the spaces work as the heat absorbers and the shock absorbers. In the above embodiment, if the vent holes are installed to the spaces in the convex portion between the lid element and the release sheet, air can go through the vent holes when an air volume change occurs by the heat transmission or by the outer force transmission or by the air pressure change.

The second merit is the merit that the release of the lid element from the release sheet becomes easy.

For example, when the area where the convex portion is installed is the center area part of the lid element, the second adhesive is applied to the outer margin area where the convex portion is not formed and the second adhesive is not applied to the center area. By this configuration, the area where the second adhesive is applied becomes small, and the release of the lid element from the release sheet becomes easy.

In addition, if the second adhesive is applied to the center part area, it is inconvenient if the surface of the lid element has the adhesion because the second adhesive remains on the surface of the lid element after sealing the opening of micro tube. Therefore, it is preferable that the second adhesive is applied to the outer margin area if the convex portion is installed in the center area part of the lid element.

Next, the area where the first adhesive is applied is described below. The first adhesive is applied to the surface of the lid element sheet, and the first adhesive exists between the lid element and the opening of the micro tube. Therefore, the first adhesive applied to the outer margin area works effectively, in opposition, the first adhesive applied to the center area does not work for binding the micro tube and the lid element at all. If the first adhesive 110 exists in the center area of the lid element, the first adhesive 110 remains on the back surface of the lid element after sealing the opening of micro tube, and there is an influence on the storing condition. Therefore, it is preferable that the first adhesive is applied to the outer margin area if the convex portion is installed in the center area part of the lid element.

As shown above, the opening of the micro tube is sealed by the lid element bound by the second adhesive, the sealing method is not limited. There is several sealing method as shown below.

The first sealing method is heating and fusing method. If the heating and fusing method is applied, it is preferable that the material of the lid element is foil sheet for enduring heating operation.

The second sealing method is a non-heating and pressing method. If the non-heating and pressing method is applied, the plastic sheet can be applied as the material of the lid element.

The structure of the lid element can be a single layer structure or a combined layer structure with plural piled up materials.

Next, the variation for the lid element for management of the micro tube after sealing the lid element array is shown below.

If the identification code information is carried onto the surface facing the release sheet, the identification code information turns to be on the top surface of the micro tube sealed by the lid element, and each micro tube can be identified independently by utilizing the identification code information.

The lid element array of the present invention is provided as a part of the micro tube array set. A micro tube array set including a micro tube array in which a plurality of micro tubes are arrayed and a lid element array for sealing the opening of a plurality of micro tubes comprises; a plurality of independent micro tubes; a storage rack for arraying a plurality of said micro tubes; a lid element array including a plurality of lid elements for sealing the opening of a plurality of micro tubes comprising; a lid element sheet wherein a plurality of said lid elements are arrayed corresponding to the number and the arrangement of a plurality of said micro tubes arrayed in said micro tube array; a release sheet for supporting said lid element sheet from bottom side; a first adhesive applied at least to a predetermined area of each said lid element in said lid element sheet; a second adhesive applied between said lid element sheet and said release sheet; wherein, each said lid element in said lid element sheet is supported by said release sheet where a cut-line cut around the edge of each said lid element for separation from said lid element sheet, each said lid element moves to corresponding said opening of each said micro tube and seals the same by pressing said lid element to the surface of said micro tube array for facing the surface applied said first adhesive and the surface of said micro tube array.

Next, the variation for the micro tube array set for management of the micro tube after sealing the lid element array is shown below. If the identification code information is carried on the top surface of the micro tube sealed by the lid element, each micro tube can be identified independently by utilizing the identification code information.

DETAILED DESCRIPTION OF THE PREFERRED EMBODIMENT

Some embodiments of a lid element array and a micro tube array for sample storage including the same according to the present invention are described below in reference to the relevant drawing. Needless to add, the claims of the present invention include but are not limited to the application, configuration, or quantity shown in the following embodiments.

Embodiment 1

The first lid element array 100 in embodiment 1 according to the present invention is described. The first lid element array 100 shown in this embodiment 1 is a basic configuration, and the lid element 121 is a simple plate shape.

Figure 1:
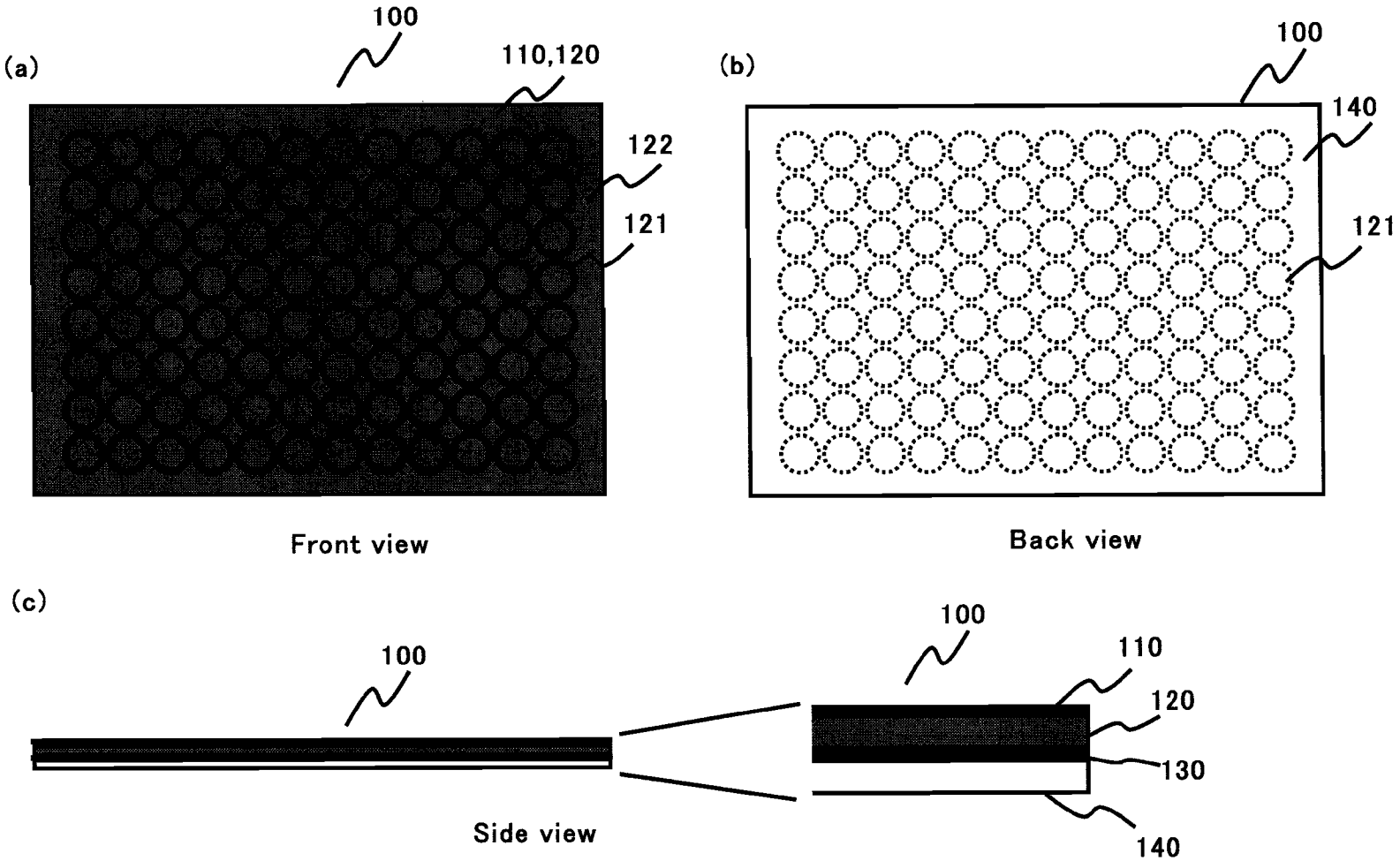
FIG. 1 is a schematic view of the first lid element array 100 in embodiment 1.
Figure 2:
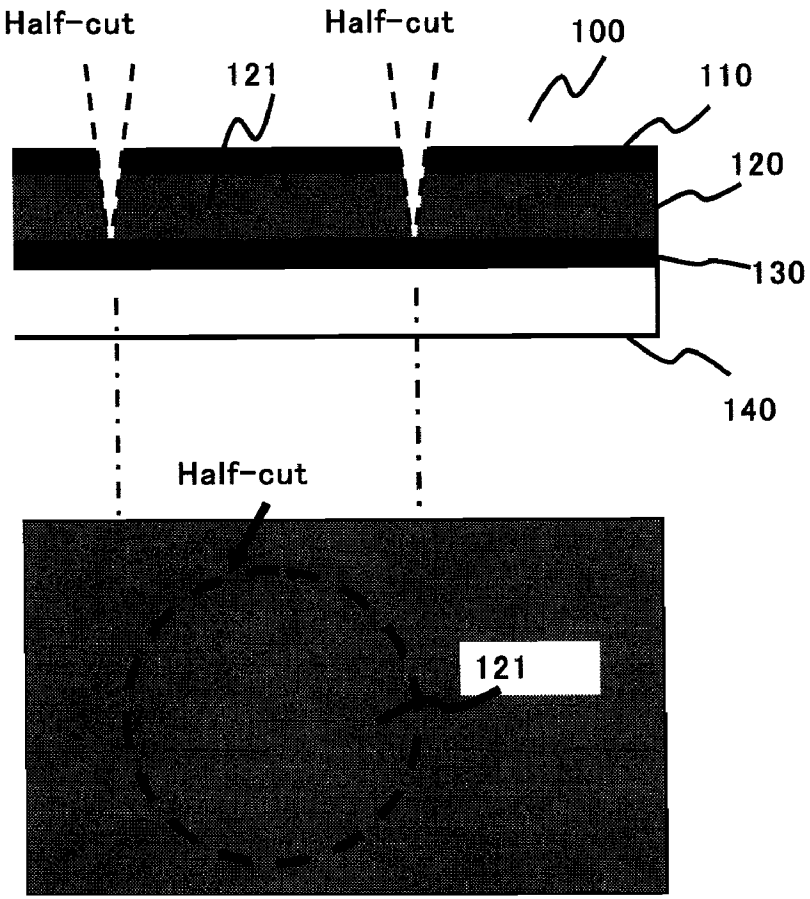
FIG. 2 is a schematic view showing the half-cut-off structure.
Figure 3:
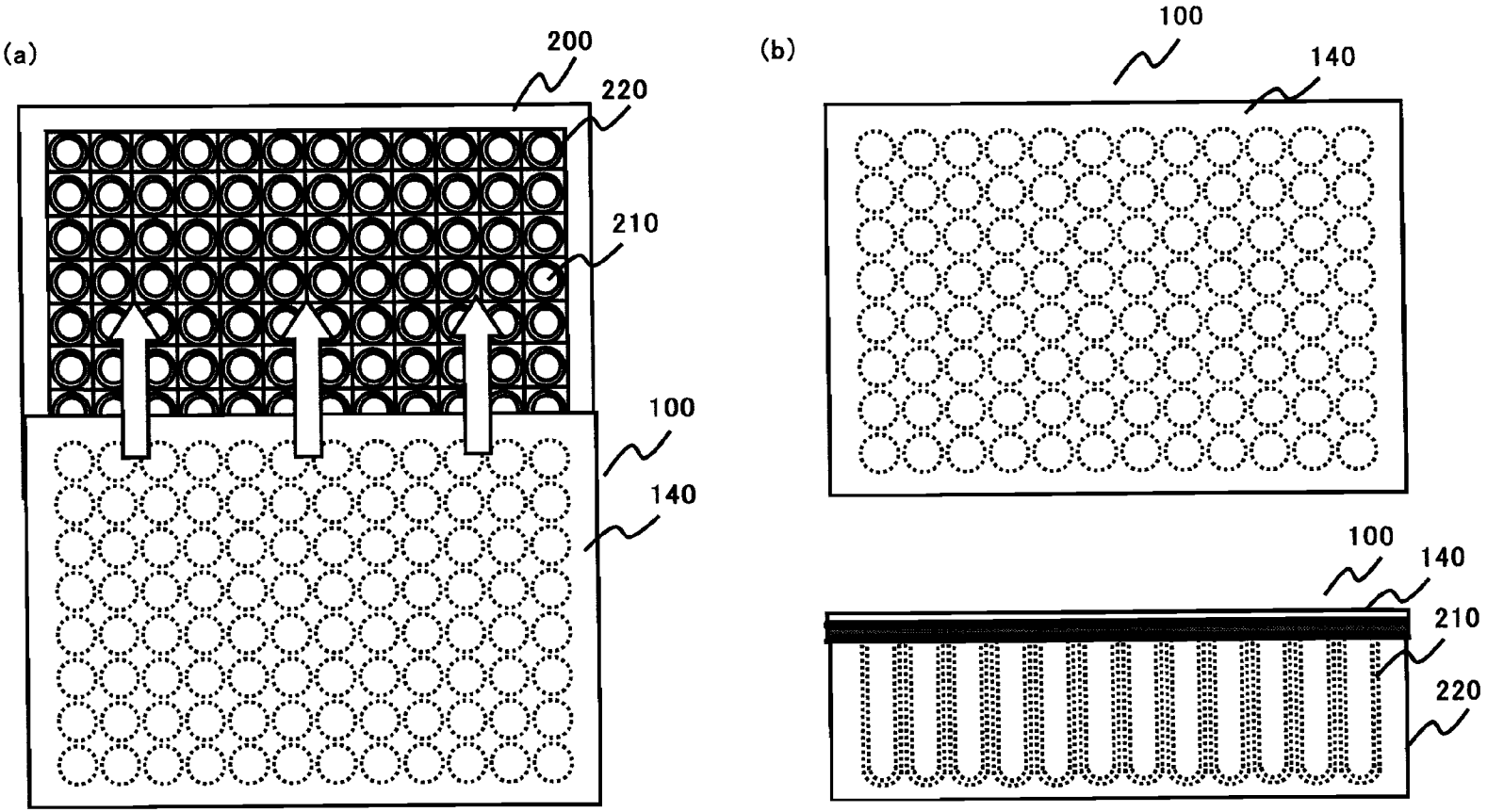
FIG. 3 is a schematic view showing the procedure for sealing the top opening of the micro tube array 200.

FIG. 1 is a schematic view of the first lid element array 100 in embodiment 1 according to the present invention. FIG. 1 (*a*) shows a top view, FIG. 1 (*b*) shows a bottom view, and FIG. 1 (*c*) shows a cross-sectional side view. FIG. 2 is a schematic view showing half-cut-off structure of the lid element, and FIG. 3 is a schematic view showing the procedure for enclosing the top opening of the micro tube array.

As shown in FIG. 1 and FIG. 2, the first lid element array 100 comprises a 4-layer structure including the first adhesive layer 110, the lid element sheet 120, the second adhesive layer 130 and the release sheet 140.

In FIG. 1 (*a*), the first adhesive layer 110 is shown in the front. The first adhesive layer 110 is made of thin and transparent material, so the lid element sheet 120 under the first adhesive layer 110 is shown.

The lid element sheet 120 is a sheet including a plurality of lid elements 121 where a plurality of lid elements 121 are arrayed corresponding to the number and arrangement of the micro tubes 210 of the micro tube array 200. In this embodiment shown in FIG. 1, the shape of each lid element 121 is circular, and a plurality of lid elements 121 are arrayed in a matrix in a sheet. The remaining part of the lid element sheet 120 except for the lid element 121 is the margin part 122.

The material of the lid element 121 is a foil sheet or a plastic sheet and so on. The structure of the lid element 121 can be a single layer structure or a combined layer structure with plural piled up materials.

There is a cut-line around the edge of each lid element 121 for assisting the separation of each lid element 121 from the lid element sheet 120. FIG. 2 is a schematic view showing the half-cut-off structure and the cut-line around the edge of each lid element 121. As shown in FIG. 2, there is cut-line in the lid element sheet 120, however, there is no cut-line in the release sheet 140.

This structure is commonly seen as the sticker, the cut-line is installed only in the lid element sheet 120 by the cut method called "half-cut-off" method for cutting the cut-line only one of two sheets of the lid element sheet 120 and the release sheet 140. As shown above, if there is the cut-line around the edge of the lid element sheet 120, the lid element 121 can be separated easily from the release sheet 140 along to the cut-line with circular shape as shown in FIG. 3.

The release sheet 140 supports the lid element sheet 120 from the back side, for example, a plastic film or a paper sheet. The remover liquid can be applied to the surface facing the lid element sheet 120. If applying the remover liquid, the lid element 121 can be released easily when releasing the lid element 121.

The first adhesive layer 110 is an adhesive layer applied to the surface of the lid element sheet 120. In other words, the first adhesive layer 110 is applied to the surface of the lid element array 100. The first adhesive layer 110 turns to be an adhesive between the lid element 121 and the opening edge of the micro tube 210 when sealing the lid element 121 to the opening of the micro tube 210 as described later.

The first adhesive layer 110 may be applied to the whole surface of the lid element sheet 120, however, it is enough to be applied to the area for contacting the opening edge of the micro tube 210 among the whole area of the lid element 121.

The opening of the micro tube 210 is sealed by the lid element 121 via the first adhesive 110, but the sealing method is not limited, and there are several methods as shown below.

The first sealing method is a heating and fusing method. The first adhesive 110 is fused by being heated and pressed and is fixed by cooling down and then the opening edge of the micro tube 210 and the lid element 121 are bound firmly. If the heating and fusing method is applied, it is preferable that the material of the lid element 121 is a foil sheet for enduring the heating operation.

The second sealing method is a non-heating and pressing method. The first adhesive 110 binds the opening edge of the micro tube 210 and the lid element 121 by being pressed. If the non-heating and pressing method is applied, the plastic sheet can be applied as the material of the lid element 121.

The structure of the lid element 121 can be a single layer structure or combined layer structure with plural piled up sheets.

It is preferable that the protection sheet is installed onto the surface (the surface of the first adhesive layer 110) of the lid element array 100 in order to protect the surface of the lid element array 100. Especially, with the non-heating and pressing method type, the first adhesive layer 110 always has adhesion in some cases, and it is preferable that the protection sheet is installed onto the surface of the lid element array 100.

The second adhesive layer 130 is an adhesive layer between the lid element sheet 120 and the release sheet 140 in order to bind the lid element sheet 120 to the release sheet 140. As described later, the binding for the lid element 121 is released when sealing the opening of the micro tube 210 with the lid element 121. However, the margin part 122 remains onto the release sheet 140 by the binding force of the first adhesive layer 110 when sealing the opening of the micro tube 210 by the lid element 121.

The micro tube array 200 comprises the micro tubes 210 and the storage rack 220. The micro tubes 210 can be installed in the storage rack 220, with many micro tubes 210 arrayed in the storage rack 220. In this embodiment, micro tube 210 forms a tubular shape, however, it may take other forms according to its intended use. The micro tube 210 is made of transparent or translucent light-transmissive material. Any material that is suitable for sample storages and that enables the sample contained to be observed is applicable, including plastic such as polypropylene, and glass. When translucent material is used in order to reduce the effect of ultraviolet rays, any material that enables the sample contained to be observed is applicable, even if it is colored white or brown.

Next, the procedure for sealing the opening of the micro tube 210 with the first lid element array 100 is described below.

For example, the procedure when the material of the lid element 121 is a foil sheet and the heating and fusing method is applied to the first adhesive 110 is described.

(Procedure 1A)

If there is the protection sheet on the lid element array 100, the protection sheet is removed, and then the lid element array 100 is placed onto the micro tube array 200, and the positioning of each lid element 121 is adjusted to each corresponding opening of the micro tube 210 (FIG. 3 (*a*) to FIG. 3 (*b*)).

(Procedure 2A)

After the positioning of the lid element 100, the lid element array 100 (the release sheet 140) is pressed to the surface of the micro tube 210 with heating around the area corresponding to the opening of the micro tube 210 by predetermined temperature and predetermined pressure. When the heat transmits to the lid element 121 of the lid element array 100 and the area where the first adhesive 110 is applied, the first adhesive 110 is fused in a moment. The heating can be applied by pressing the heating element or by irradiating the laser to the corresponding area (FIG. 4 (*a*)).

Figure 4:
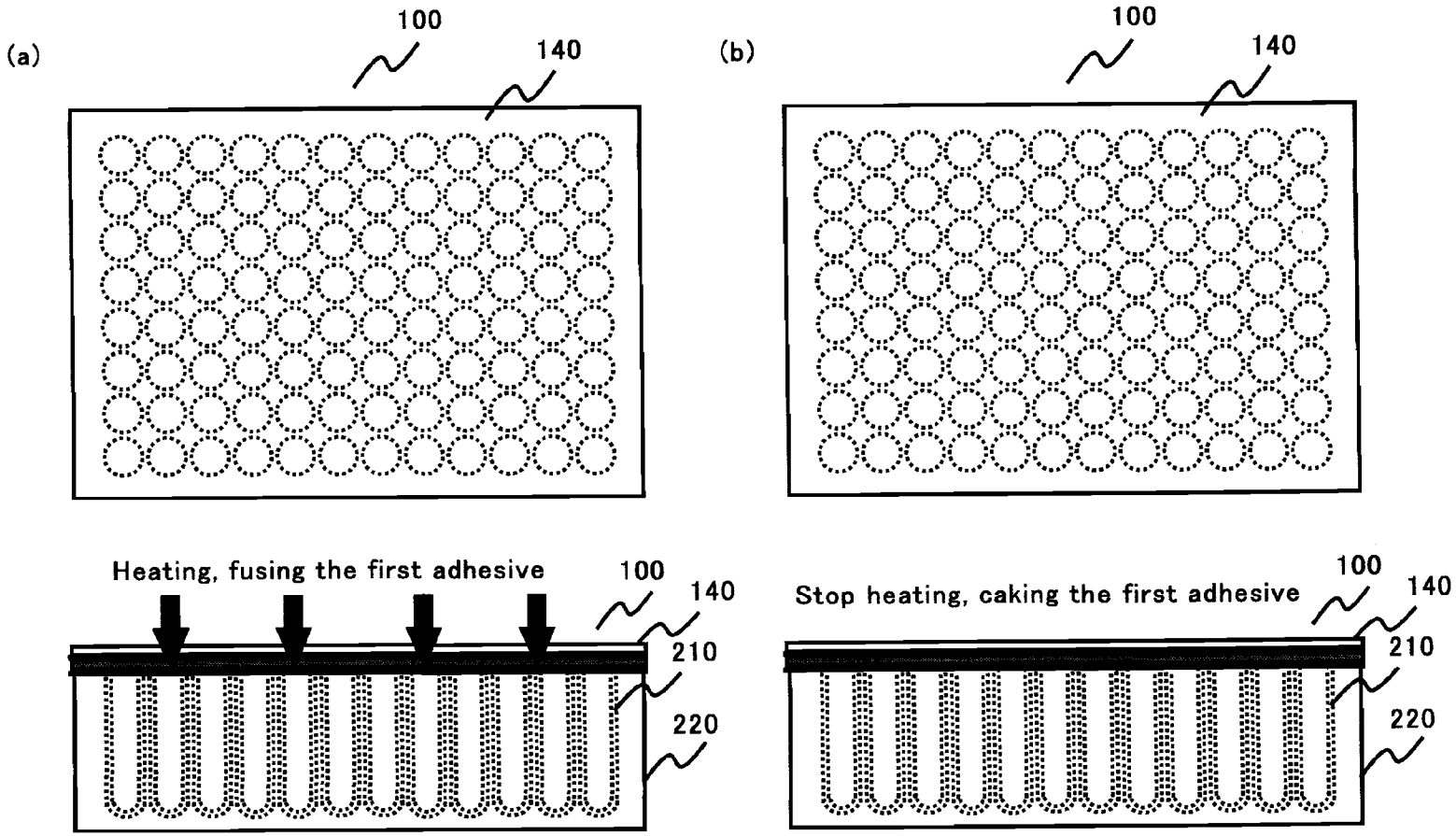
FIG. 4 is a schematic view showing sealing processing of the opening of the micro tube 210 by the lid element 121.

When the first adhesive 110 is fused, the fused adhesive 110 exists between each area around the lid element 121 of the lid element array 100 and each area around the opening of the micro tube 210 (FIG. 4 (*a*)).

(Procedure 3A)

When the heating applied to the area around the lid element 121 having the first adhesive 110 is stopped, the heated area is cooled down and the fused first adhesive 110 becomes solid. Each opening of the micro tube 210 is sealed by each lid element 121 via the first adhesive 110.

(Procedure 4A)

After securing the binding of the first adhesive 110, the lid element array 100 is removed from the surface of the micro tube 210. At this moment, each lid element 121 is bound to the top opening of the micro tube 210, so each lid element 121 is separated from the release sheet 140 and each lid element 121 moves from the lid element sheet 120 to the top opening of the micro tube 210. Each opening of the micro tube 210 is sealed by each lid element 121 (FIG. 5 (*a*) to FIG. 5 (*b*)).

Next, as another example, the procedure in the case that the material of the lid element 121 is a plastic film sheet and the non-heating and pressing method is applied to the first adhesive 110 is described.

(Procedure 1B)

The positioning procedure (Procedure 1B) of the lid element array 100 is the same as the positioning procedure of the heating and fusing method (Procedure 1A), so the detailed explanation is omitted here.

(Procedure 2B)

After the positioning of the lid element 100, the backside of the lid element array 100 (the release sheet 140) is pressed to the surface of the micro tube 210 with pressing around the area corresponding to the opening of the micro tube 210 by predetermined pressure. When the pressure is applied to the lid element 121 of the lid element array 100, the area where the first adhesive 110 is applied is pressed, and the first adhesive 110 binds to the facing top opening of the micro tube 210.

(Procedure 3B)

The procedure 3B is the same as the procedure 4A of the heating and fusing method. After securing the binding of the first adhesive 110, the lid element array 100 is removed from the surface of the micro tube 210. At this moment, each lid element 121 is bound to the top opening of the micro tube 210, so each lid element 121 is separated from the release sheet 140 and each lid element 121 moves from the lid element sheet 120 to the top opening of the micro tube 210. Each opening of the micro tube 210 is sealed by each lid element 121.

Figure 5:
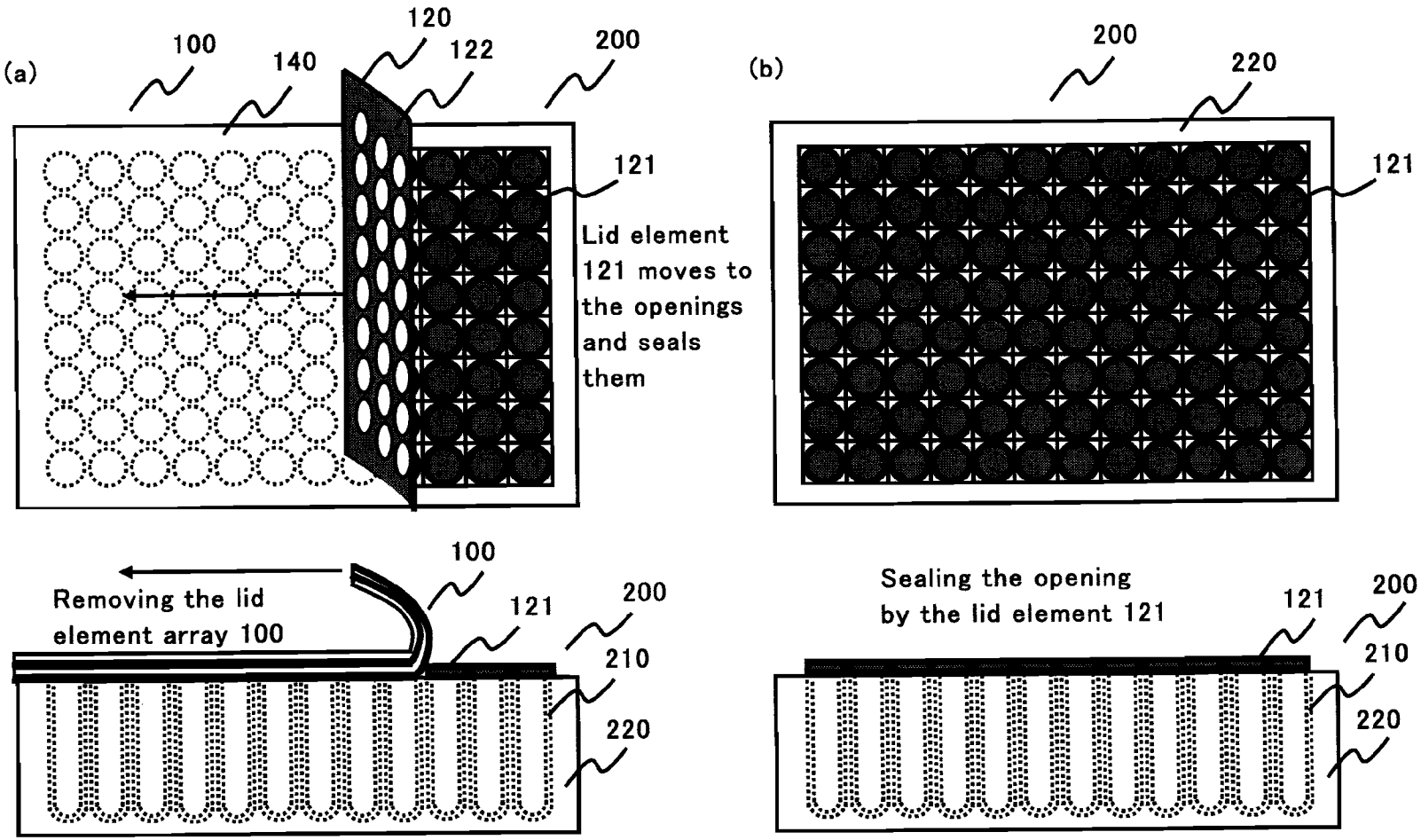
FIG. 5 is a schematic view showing that each lid element 121 moves to the opening of the micro tube 210 and seals by removing the lid element array 100.

FIG. 5 (*b*) shows each sealed opening of the micro tube 210 by each lid element 121 according to the above-mentioned procedure of the heating and fusing method or the above-mentioned procedure of the non-heating and pressing method. A lot of micro tube 210 are arrayed in the storage rack 220.

Each micro tube 210 is independent, so the micro tube 210 can be taken out and examined each by each, in addition, the volume of the storage rack 220 is utilized effectively by collecting the micro tube 210 which storage condition are the same according to the stored test sample and arraying in one storage rack 220.

Embodiment 2

The second lid element array 100*a* in embodiment 2 according to the present invention is described. In the second lid element array 100*a* shown in this embodiment 2, the lid element 121 has a convex portion. The convex portion is used as a positioning guide when sealing the lid element 121 to the opening of the micro tube 210. In addition, the convex portion can assist the removing of the lid element 121 when opening the lid element 121, and the air enclosed in the convex portion 123 becomes the shock absorber and the heat absorber.

Figure 6:
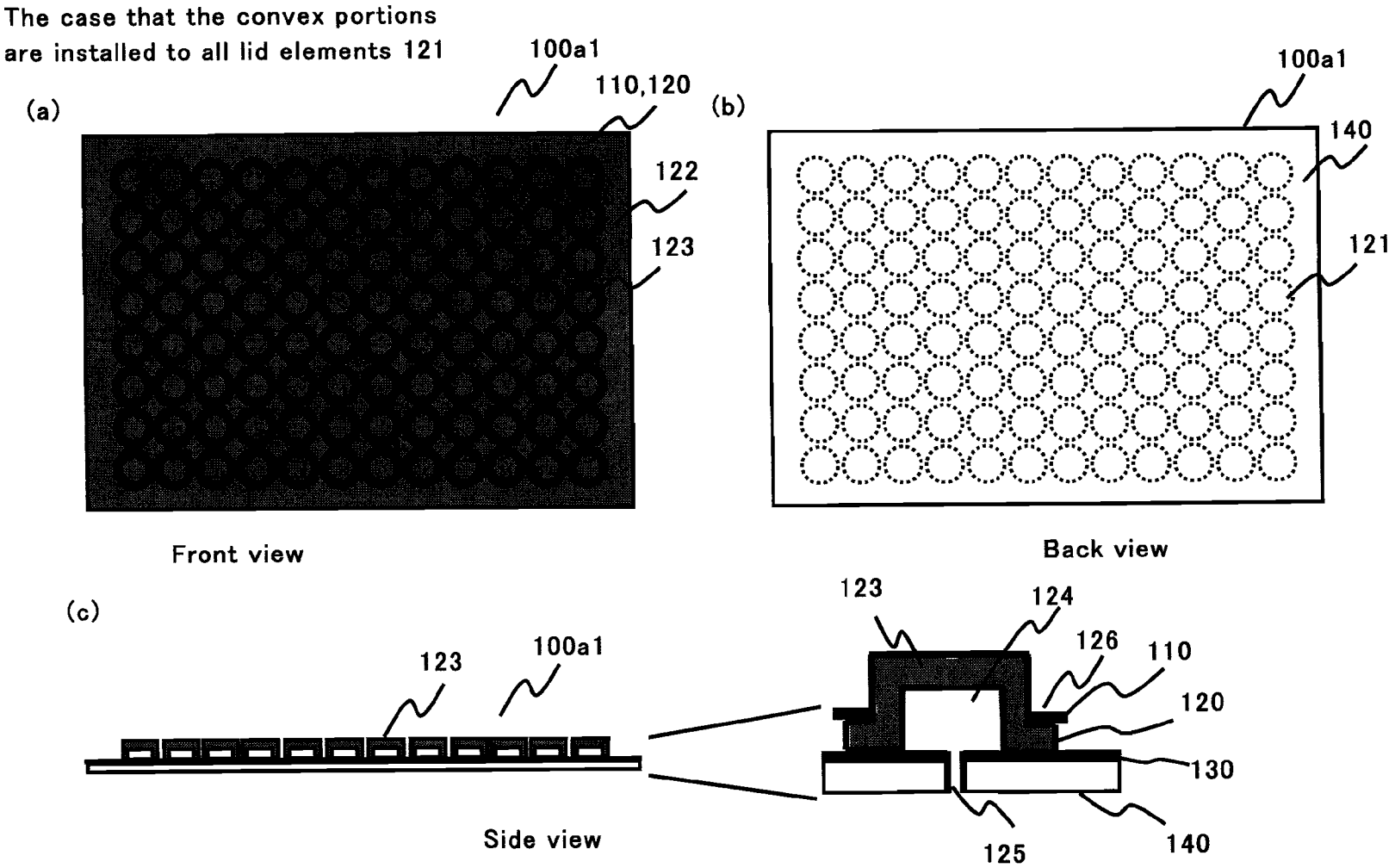
FIG. 6 is a schematic view of the second lid element array 100*a* in embodiment 2.

FIG. 6 is a schematic view of the second lid element array 100*a* in embodiment 2 according to the present invention. FIG. 6 shows a top view, a bottom view and a cross-sectional side view.

As shown in FIG. 6, the second lid element array 100*a* comprises the first adhesive layer 110, the lid element sheet 120, the second adhesive layer 130 and the release sheet 140, wherein the lid element sheet 120 has the convex portion 123, the space 124 and the vent hole 125 on the surface of each lid element 121. The remaining part of the lid element 121 except for the convex portion 123 is the margin part 126, the remaining part of the lid element sheet 120 except for the lid element 121 is the margin part 122.

As shown in FIG. 6, the convex portion 123 is made on the surface of the lid element 121. In this embodiment 2, the convex portion 123 is made by the embossed process to the lid element 121, and the air space 124 is made between the lid element 121 and the release sheet 140. In this embodiment shown in FIG. 6, a convex portion 123 is located on the surface of each lid element 121.

The convex portion 123 can have plural functions shown below.

The first function of the convex portion 123 is the assistance function for positioning the lid element array 100*a* to the surface of the micro tube array 200.

Figure 7:
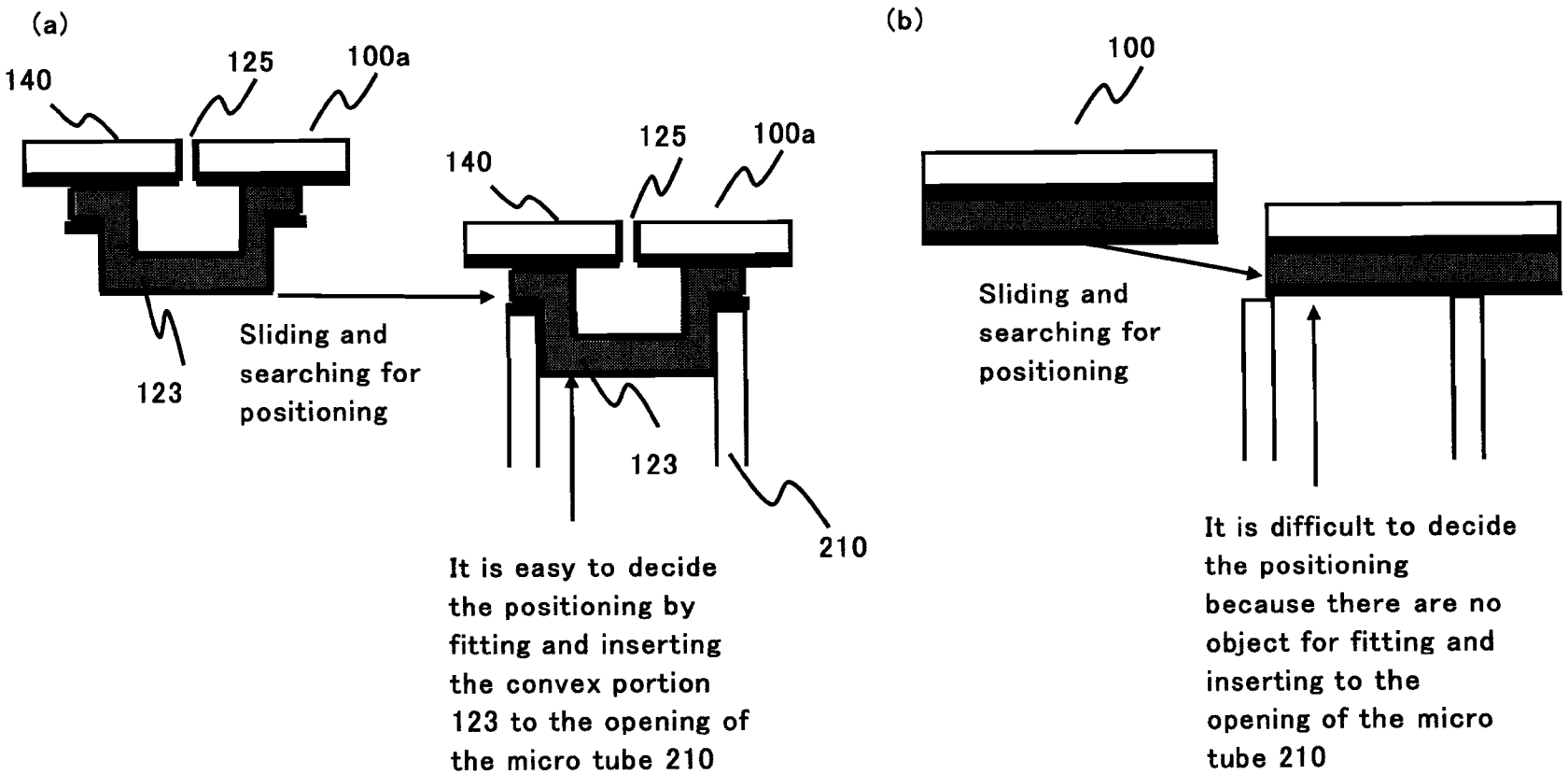
FIG. 7 is a perspective view showing the positioning procedure in the case that the convex portion 123 is located on the lid element 121 and in the case that the convex portion 123 is not located on the lid element 121.

FIG. 7 (*a*) is a perspective view showing the positioning procedure in the case that the convex portion 123 is located on the lid element 121 and in the case that the convex portion 123 is not located on the lid element 121.

As shown in FIG. 7 (*a*), in the case that the convex portion 123 is located on the lid element 121, the positioning is conducted easily by utilizing the convex portion 123 as the positioning guide because the convex portion 123 can be inserted easily to the top opening of the micro tube 210, which is in a concave shape. On the other hand, as shown in FIG. 7 (*b*), the case in which the convex portion 123 is not located on the lid element 121, the positioning cannot be conducted easily because there is no positioning guide.

If the shape and the size of the convex portion 123 are adjusted according to the top opening of the micro tube 210, the convex portion 123 can be inserted in the top opening of the micro tube 210 without needless margin, therefore, the positioning function for positioning the lid element array 100*a* to the micro tube array 200 is obtained.

Figure 8:
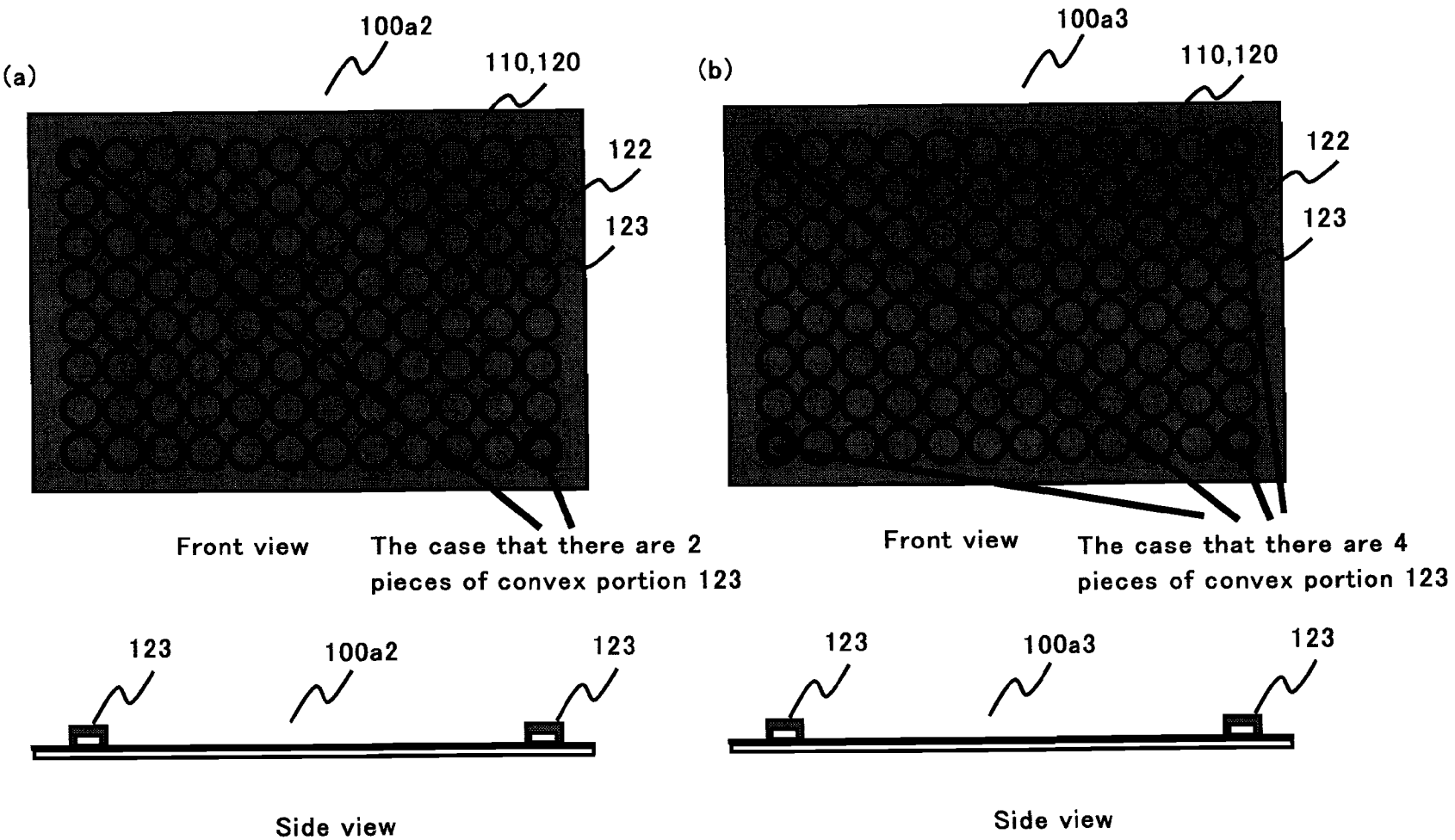
FIG. 8 is a perspective view showing the positioning of the lid element array 100*a* using 2 pieces or 4 pieces of the convex portion 123.

In the case that the convex portion 123 is used as the positioning guide when sealing the lid element 121 to the micro tube 210, the positioning can be decided if the positioning of the lid element array 100*a* to the micro tube array 200 as a whole is decided. Therefore, the convex portion 123 is not required for all top openings of the micro tubes 210, and the positioning of the lid element array 100*a* can be decided by using at least 2 pieces of the convex portion 123 (for example, the upper right and the lower left) as shown in FIG. 8 (*a*), preferably 4 pieces of the convex portion 123 (for example, four corners) as shown in FIG. 8 (*b*) as the positioning guide.

However, in this embodiment 2, the convex portion 123 shows not only the first function for the positioning the lid element array 100*a* but also the second function and the third function, and the convex portions 123 are provided for every lid element 121 as shown in FIG. 6.

The second function of the convex portion 123 is the release function for releasing the lid element 121 from the release sheet.

The convex portion 123 is made on the surface of the lid element 121 by the embossed process with the air space 124, and the second adhesive 130 is present between the margin 126 and the release sheet 140 and is not present between the convex portion 123 and the release sheet 140. Therefore, the area where the second adhesive 130 is present becomes small, and the lid element 121 easily can be separated from the release sheet 140 when pressing the lid element 121 to the top opening of the micro tube 210 and sealing the top opening of the micro tube 210.

Figure 9:
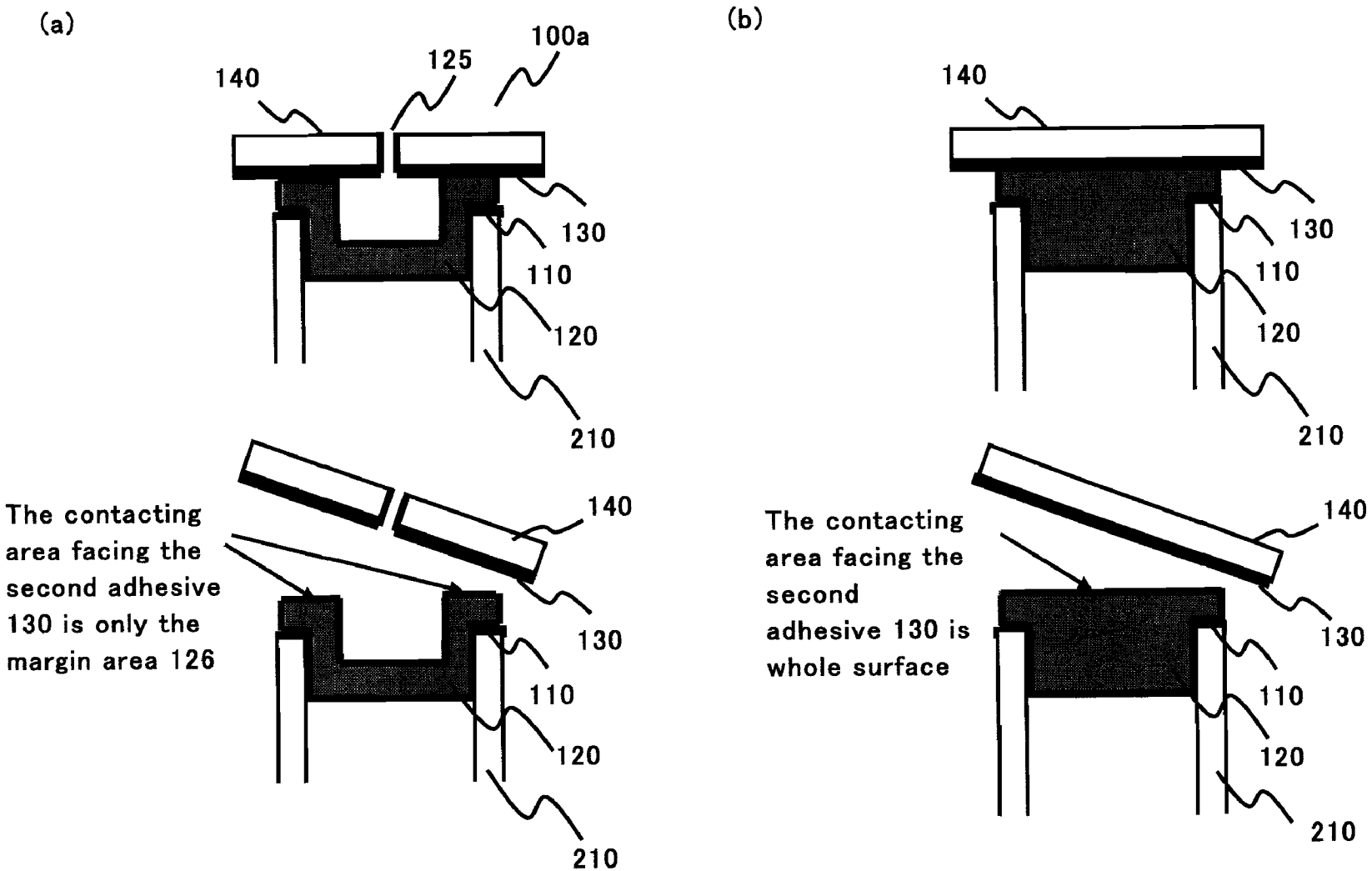
FIG. 9 is a perspective view showing the releasing procedure in the case that the second adhesive 130 is present on the whole back surface area of the lid element 121 and in the case that the second adhesive 130 is present only in the margin 126 area of the lid element 121.

FIG. 9 is a perspective view showing the releasing procedure when the second adhesive 130 is present over the whole back surface area of the lid element 121 and in the case that the second adhesive 130 is present only in the margin 126 area of the lid element 121.

As shown in FIG. 9 (*b*), the second adhesive 130 is present over the whole back surface area of the lid element 121, large tension will be generated when releasing the lid element 121 because the adhesive surface area is large. In contrast, as shown in FIG. 9 (*a*), the second adhesive 130 is present in the margin 126 area of the lid element 121, only small tension will be generated when releasing the lid element 121 because the adhesive surface area is small.

In addition, as shown in FIG. 9 (*b*), the second adhesive 130 is present over all the back surface area of the lid element 121, and the second adhesive 130 remains on the surface of the lid element 121 after sealing the opening of micro tube 210. In contrast, as shown in FIG. 9 (*a*), the second adhesive 130 is present in the margin 126 area of the lid element 121, the second adhesive 130 does not remain on the surface of the lid element 121 after sealing the opening of micro tube 210, and the surface of the lid element 121 becomes clean.

Figure 10:
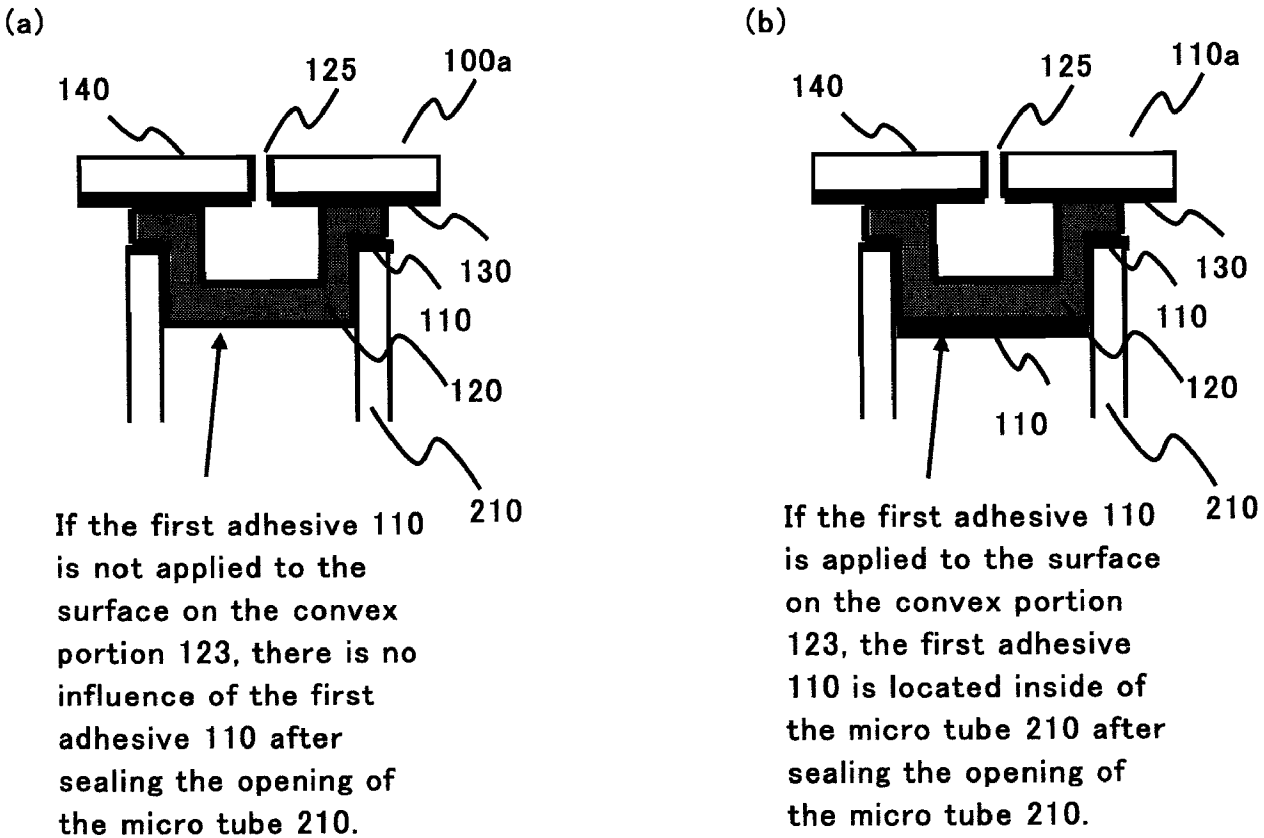
FIG. 10 shows the sealing status of the micro tube 210 in the case that the first adhesive 110 is present on the whole back surface area of the lid element 121 and the sealing status of the micro tube 210 in the case that the first adhesive 110 is present only in the margin 126 area of the lid element 121.

Regarding the first adhesive 110, the first adhesive 110 is applied only to the margin 126 in this embodiment 2 so the first adhesive 110 is present between the edge portion of the lid element 121 and the top opening of the micro tube 210. The area of the lid element 121, which actually contacts the top opening of the micro tube 210 corresponds to the margin 126. Therefore, it is enough that the first adhesive 110 is applied to the margin 126. FIG. 10 shows the sealing status of the micro tube 210 when the first adhesive 110 is present over all the back surface area of the lid element 121 and the sealing status of the micro tube 210 when the first adhesive 110 exists in the margin 126 area of the lid element 121.

In addition, as shown in FIG. 10 (*b*), the first adhesive 110 is present over all the back surface area of the lid element 121, and the first adhesive 110 remains on the rear surface of the lid element 121 which is located in an inner space for storing the sample after sealing the opening of micro tube 210. In contrast, as shown in FIG. 10 (*a*), the first adhesive 110 is present in the margin 126 area of the lid element 121, the first adhesive 110 does not remain on the back surface of the lid element 121 after sealing the opening of micro tube 210, and there is no influence on the storing condition.

Figure 11:
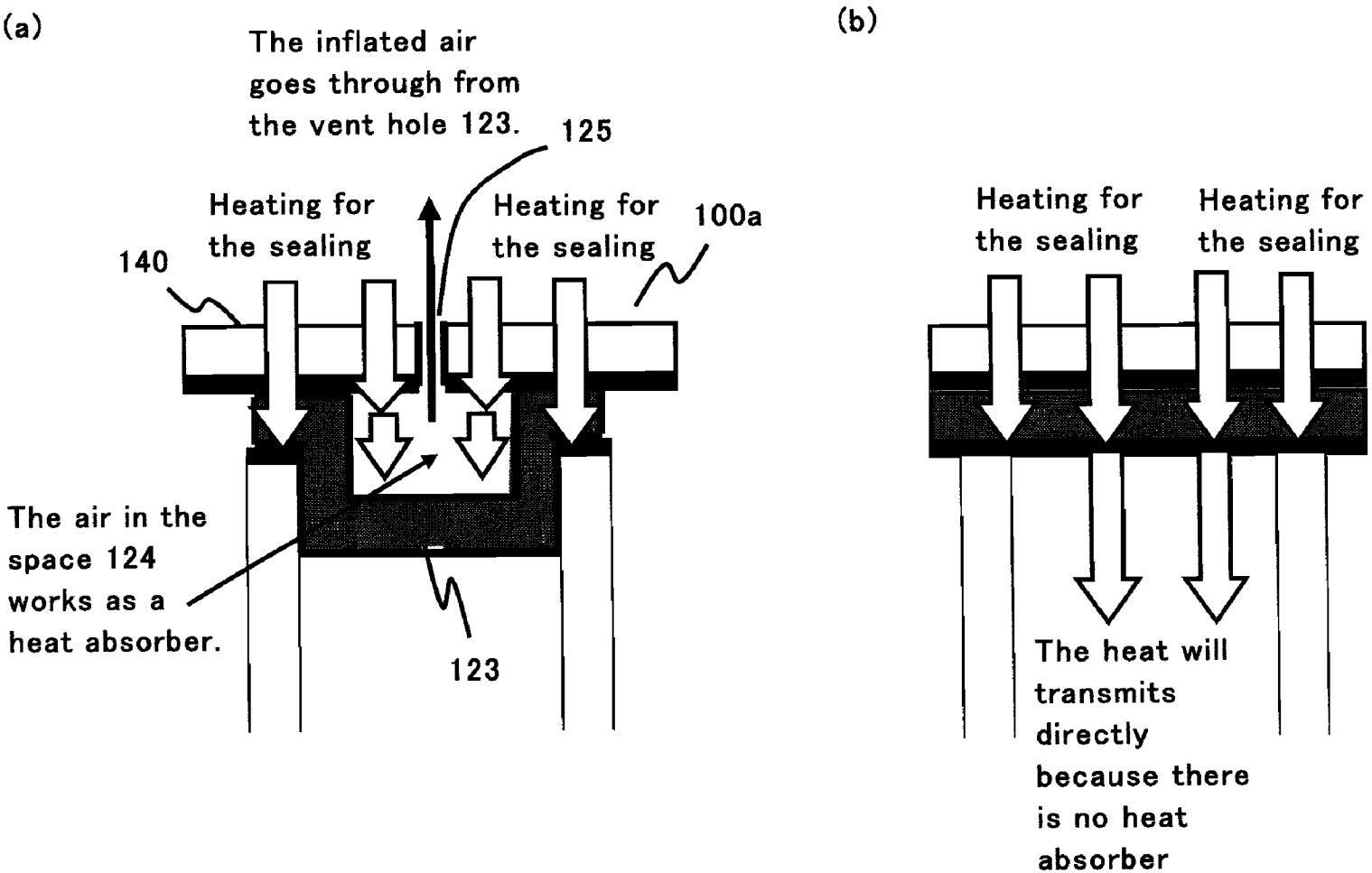
FIG. 11 shows the case that there is air in the space 124 as the heat absorber and the case that there is no space for the air as the heat absorber.

The third function of the convex portion 123 is the heat absorbing function for absorbing heat influence by the air in the space 124 of the convex portion 123. FIG. 11 shows the case that there is air in the space 124 as the heat absorber and the case that there is no space for the air as the heat absorber.

As shown in FIG. 11 (*a*), heat transmits from the upper side, and heat transmitted to the area corresponding to the margin 126 will reach the first adhesive 110 through the release sheet 140 and the lid element sheet 120 and the first adhesive 110 is fused. In opposition, heat transmitted to the center area will reach the release sheet 140 but does not reach the lid element 121 because there is air in the space 124 working as the heat absorber, and heat transmission can be blocked in short periods. Surplus heat does not transmit to the lid element 121, heat does not reach the storage space for test sample, and there is no influence on the sample storage condition.

If heat transmits to the air in the space 124, there is possibility that the air in the space 124 inflates and the air pressure in the space 124 becomes large, therefore, the vent hole 125 is installed for air ventilation at the convex portion 123 in this embodiment 2.

In contrast, as shown in FIG. 11 (*b*), if there is no air for heat absorber, heat can transmit to the lid element 121 and there is possibility that heat transmits to the inner space of the micro tube 210 and gives some influence on the storing condition. Especially, the lid element 121 is made of a foil sheet such as aluminum sheet, heat transmits easily through the lid element 121 and reaches the inner space of the micro tube 210 easily.

Regarding the processing for the convex portion 123, the convex portion can be made by gluing the column to the surface of the lid element 121 instead of the above-shown embossed processing, however, the space 124 is not provided by this gluing processing. In contrast, when the convex portion is formed by the embossed processing to the plate, the space 124 is provided as shown in FIG. 9 (*a*), and the air in the space 124 will work as a heat absorber and a shock absorber for the lid element array 100 as shown in FIG. 11.

The vent hole 125 is a hole installed in the convex portion 123 facing the release sheet 140 side. As shown in FIG. 11, the volume change of the air in the space 124 when heat or outer force reaches the space 124 or the air pressure change occurs, there is a possibility that the material forming the convex portion 123 is broken by the increase of the air pressure of the space 124 when there is no vent hole 125. If there is a vent hole 125, the air pressure can be adjusted by venting the air when the volume of the air in the space 124 changes.

Next, the procedure for sealing the opening of the micro tube 210 by the second lid element array 100*a* is described below.

For example, the procedure when the material of the lid element 121 is a foil sheet and the heating and fusing method is applied to the first adhesive 110 is described.

(Procedure 1C)

If there is the protection sheet on the lid element array 100*a*, the protection sheet is removed, then the lid element array 100*a* is placed onto the micro tube array 200, and the positioning of each lid element 121 is adjusted to the corresponding each opening of the micro tube 210.

Each convex portion 123 can easily be inserted to the corresponding top opening of the micro tube 210, each convex portion 123 works as a positioning guide.

(Procedure 2C)

After the positioning of the lid element 100*a*, the lid element array 100*a* (the release sheet 140) is pressed to the surface of the micro tube 210 with heating around the area corresponding to the opening of the micro tube 210 by predetermined temperature and predetermined pressure. When the heat reaches the lid element 121 of the lid element array 100*a* and the area where the first adhesive 110 is applied, the first adhesive 110 is fused in the moment.

When the first adhesive 110 is fused, the fused adhesive 110 exists between each area around the lid element 121 of the lid element array 100*a* and each area around the opening of the micro tube 210.

(Procedure 3C)-(Procedure 4C)

The procedure 3C (Caking processing of the fused first adhesive 110 by stopping the heat processing and sealing processing of each opening of the micro tube 210 by each lid element 121) and the procedure 4C (Removing processing of the lid element array 100*a* from the micro tube 210 and separating processing of the lid element 121 separated from the lid element sheet 120) are the same as the procedure 3A to the procedure 4A, so the detailed explanation is omitted here.

Embodiment 3

The third lid element array 100*b* in embodiment 3 according to the present invention is described. In the third lid element array 100*b* shown in this embodiment 3, the third lid element array 100*b* has a wall type convex portion at the margin 122 area except for the lid element 121 area. The wall type convex portion is used as a positioning guide when sealing the lid element 121 to the opening of the micro tube 210.

Figure 12:
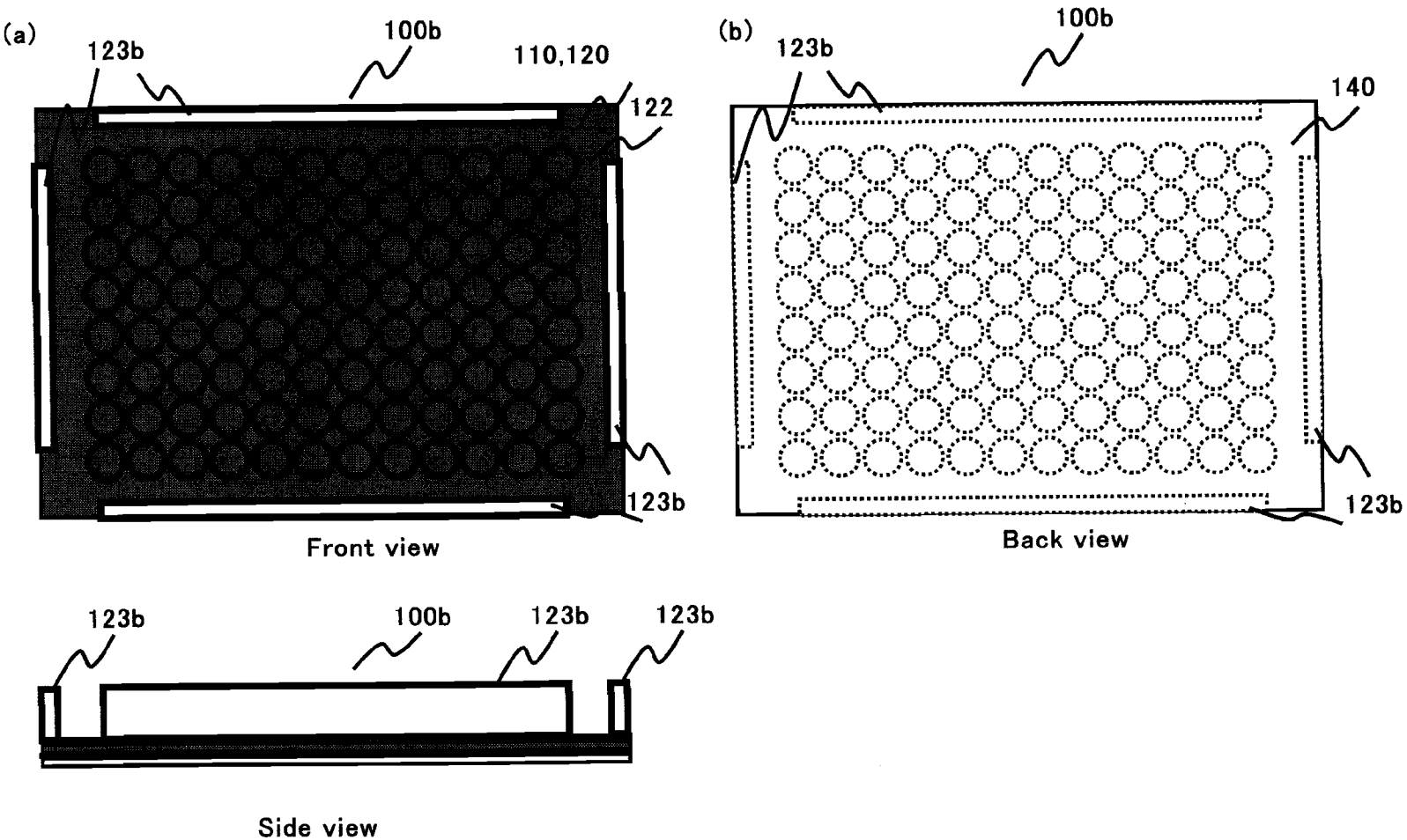
FIG. 12 is a schematic view of the third lid element array 100*b* in embodiment 3.

FIG. 12 is a schematic view of the third lid element array 100*b* in embodiment 3 according to the present invention. FIG. 12 shows a top view, a bottom view and a cross-sectional side view.

As shown in FIG. 12 (*a*), the third lid element 100*b* comprises the first adhesive layer 110, the lid element sheet 120, the second adhesive layer 130 and the release sheet 140, wherein the lid element sheet 120 has the convex portion 123*b* on the surface of the margin 122 area except for the lid element 121 area.

In the example shown in embodiment 2, the convex portion 123 whose shape corresponds to the shape of the opening of the micro tube array 200 is formed on the lid element 121. In the example shown in embodiment 3, four pieces of the wall type convex portion 123*b* corresponding to the outer edges are formed on the margin 122 area except for the lid element 121 as shown in FIG. 12.

Four pieces of the wall type convex portion 123*b* correspond to four edges of the micro tube 200, the lid element array 100*b* is larger than the micro tube array 200 and the micro tube array 200 is pinched by the four pieces of the wall type convex portion 123*b*.

Figure 13:
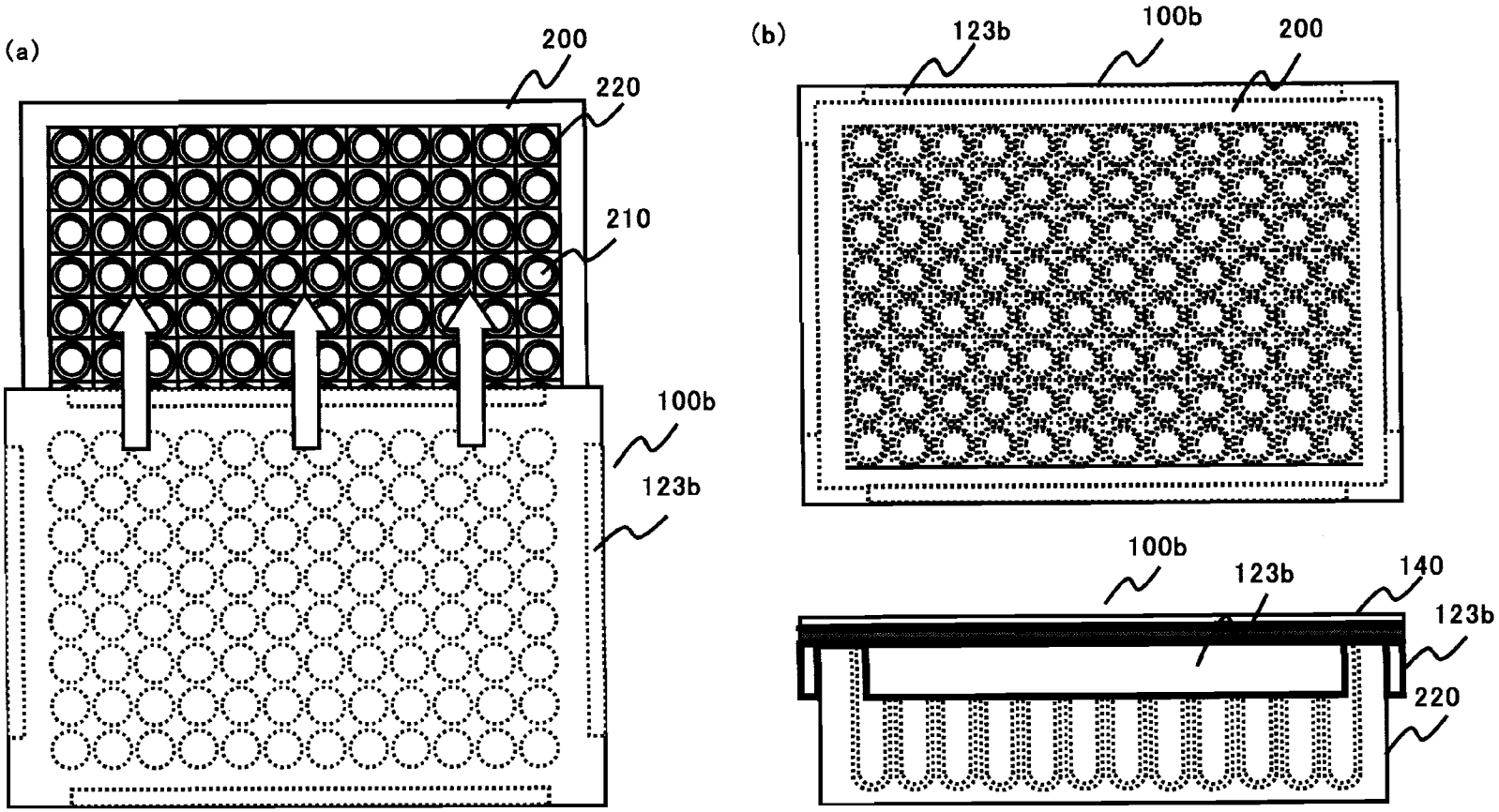
FIG. 13 is a perspective view showing the positioning procedure by using the third lid element 100*b*.
Figure 14:
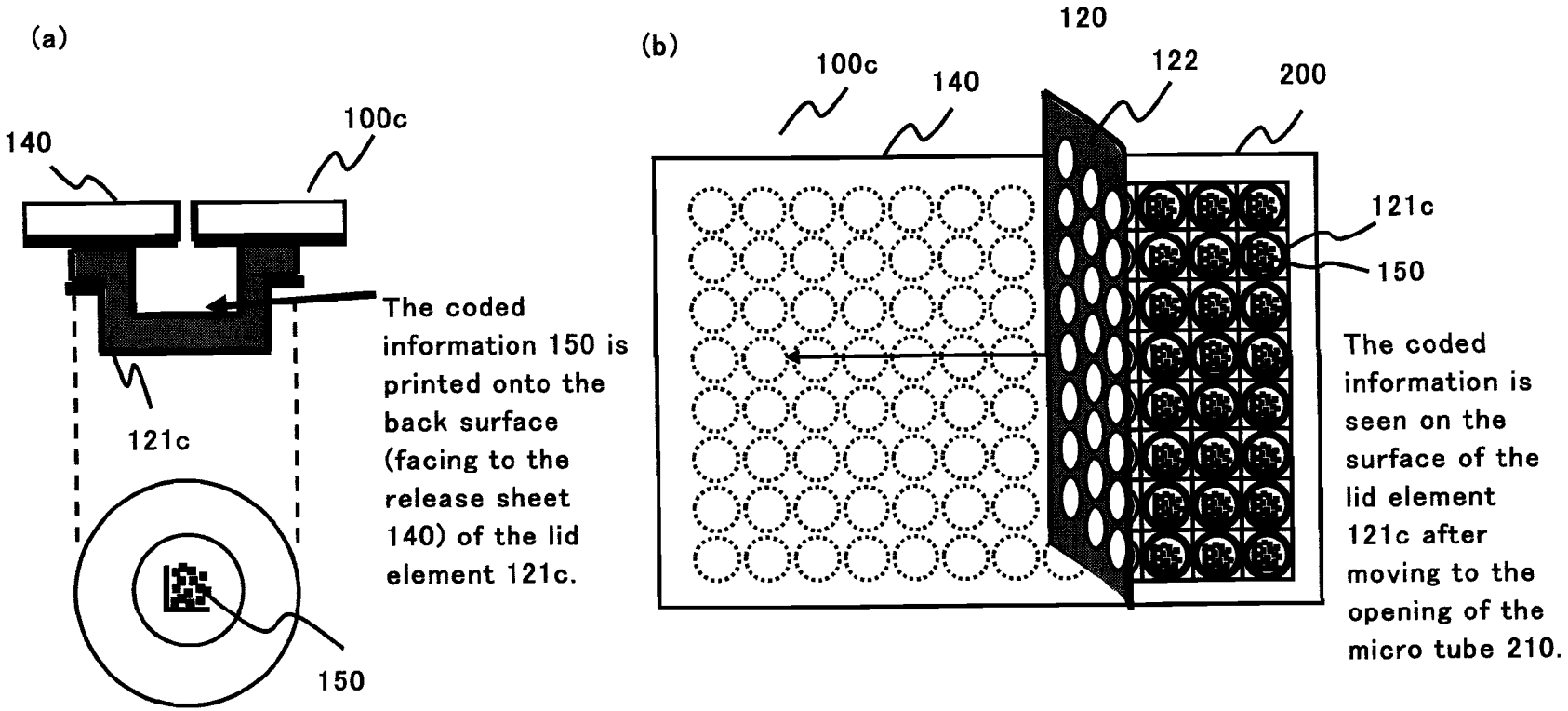
FIG. 14 is a schematic view of the fourth lid element array 100*c* in embodiment 4.
Figure 15:
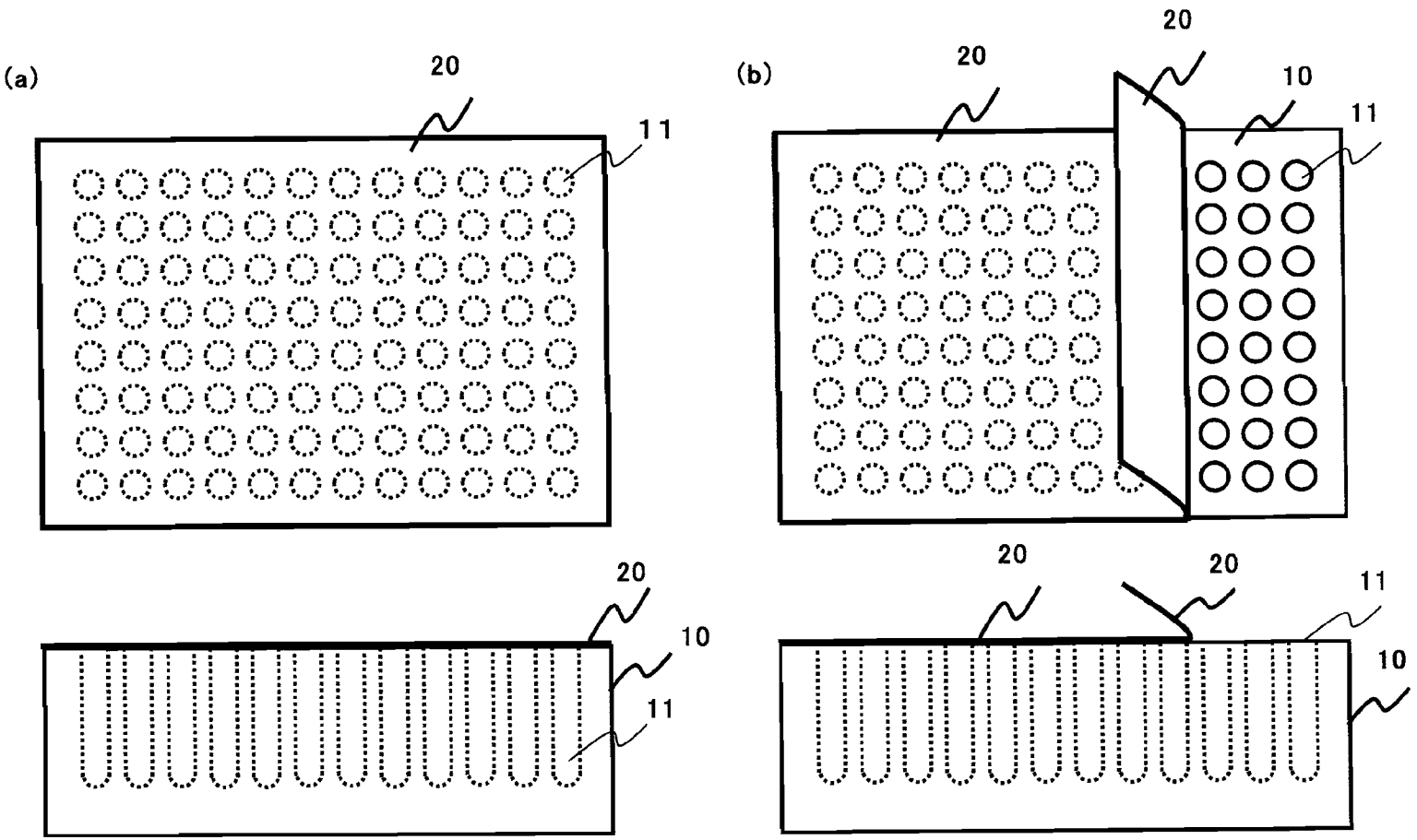
(PRIOR ART) Fig.15
FIG. 15 is a schematic view showing the case covering the whole surface of the conventional well-plate type of the sample storage block by a lid sheet.
Figure 16:
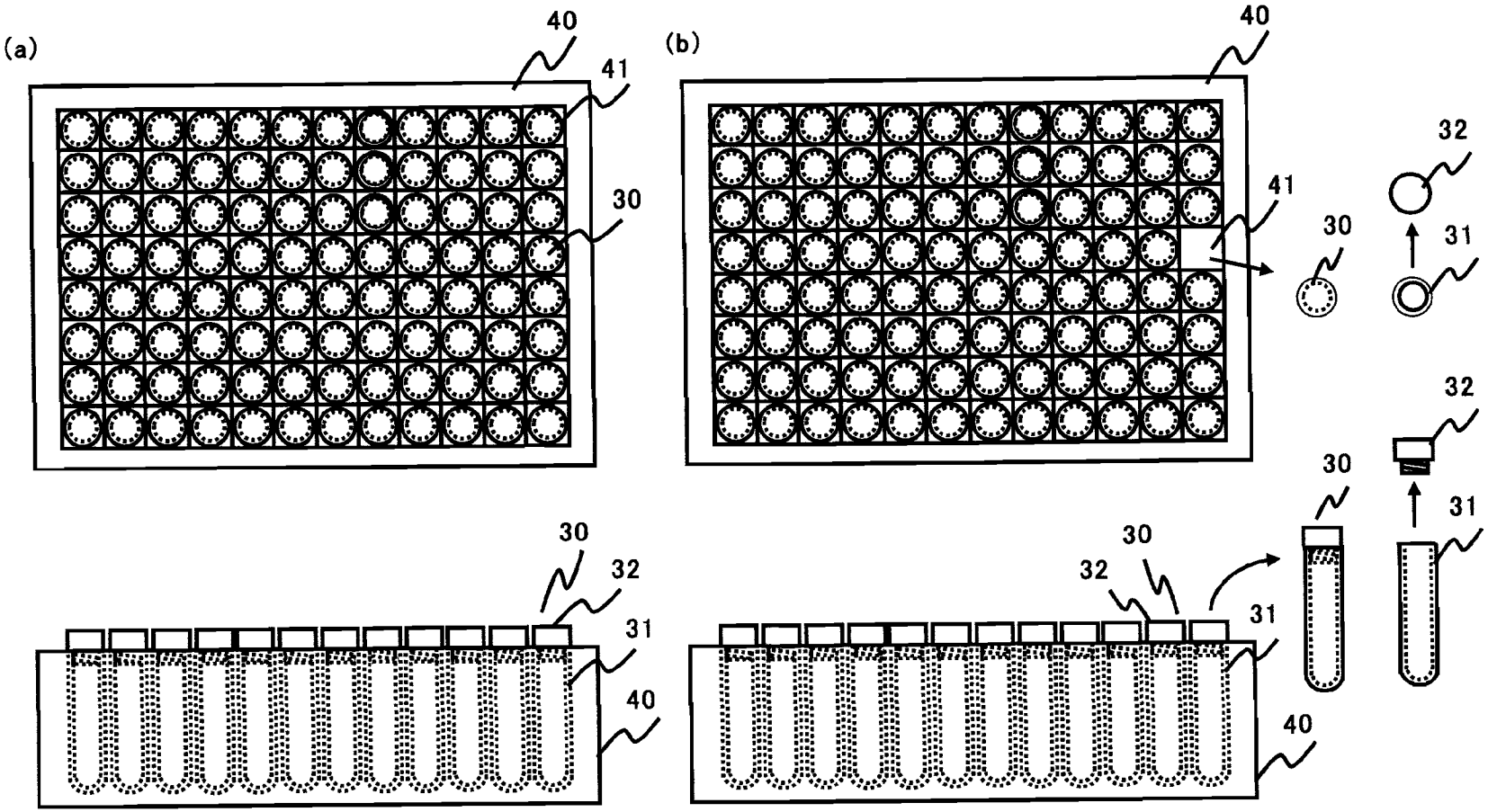
(PRIOR ART) Fig.16
FIG. 16 is a schematic view showing the case enclosing the opening of each micro tube of the conventional micro tube array by each lid.

As shown in FIG. 13, the wall type convex portion 123*b* is used as the positioning guide in the positioning processing because the micro tube array 200 is pinched by the four pieces of the wall type convex portion 123*b*. The convex portion 123 shown in embodiment 2, each convex portion 123 can be inserted to any opening of the micro tube 210, however, the wall type convex portion 123*b* shown in embodiment 3, each wall type convex portion 123*b* just corresponds to each edge of the micro tube 210 precisely. If the positioning is not correct, the micro tube 210 is not pinched by the four pieces of the wall type convex portion 123*b*. It is easy to recognized that the positioning is conducted successfully or not.

It is possible to combine four pieces of the wall type convex portion 123*b* shown in embodiment 3 and the convex portion 123 formed on the lid element 121 shown in embodiment 2.

Next, the procedure for sealing the opening of the micro tube 210 with the third lid element array 100*b* is described below.

(Procedure 1D)

If the protection sheet is on the lid element array 100*b*, the protection sheet is removed, then the lid element array 100*b* is placed onto the micro tube array 200, and the positioning of each lid element 121 is adjusted to the corresponding opening of the micro tube 210.

Each wall type convex portion 123*b* formed on the margin 122 can be along to the corresponding edge of the micro tube 210, each wall type convex portion 123*b* works as a positioning guide. The positioning is conducted easily.

As shown in FIG. 13, if 4 pieces of the wall type convex portion 123*b* is along to the corresponding 4 edges of the micro tube 210 precisely, the positioning between the lid element array 100*b* and the micro tube array 200 can be conducted precisely, and each lid element 121 corresponds to each opening of the micro tube 210 precisely.

(Procedure 2D)

After the positioning of the lid element 100*b*, the lid element array 100*b* is pressed to the surface of the micro tube 210 around the area corresponding to the opening of the micro tube 210 with a predetermined pressure. When the pressure transmits to the area where the first adhesive 110 is applied, the first adhesive 110 binds to the facing top opening of the micro tube 210.

(Procedure 3D)

The procedure 3D (Removing processing of the lid element array 100*b* from the micro tube 210 and separating processing of the lid element 121 separated from the lid element sheet 120) are the same as the procedure 3B, so the detailed explanation is omitted here.

Embodiment 4

Embodiment 4 shows the example of the carrying of information by the codes written in the micro tube 200 for management according to the present invention as described below.

The micro tubes 210 arrayed in the micro tube array 200 can be taken out from the storage rack 200 independently. Therefore, each micro tube 210 should be recognized independently. Each micro tube 210 is identified by carrying the identification code information on the side of the micro tube 210 of this embodiment 4.

FIG. 12 is a schematic view of the fourth lid element array 100*c* in embodiment 4 according to the present invention.

In the fourth lid element array 100*c* in embodiment 4, the identification code 150 is printed in advance onto the surface facing to the release sheet 140, in other words the back side of the lid element 121*c*.

The back side of the lid element 121*c* turns to be the upper side surface after sealing the micro tube 210 by the lid element 121*c*. Therefore, the identification code 150 is shown on the top surface of each micro tube 210 sealed by the lid element 121*c*, and then each micro tube 210 can be identified by the identification code 150.

The identification code 150 can be barcodes or two-dimensional codes.

Various control methods using the above lid element array 100*c* can be assumed depending on its use without particular limitation. For example, every data item related to the lid element array 100*c* is checked and controlled by a computer using an allotted index. Each measured value is checked with the predetermined high and low limits, and when the data is out of the range, a retry of measurement, a report of detection of errors, or a warning is performed. In the above checking processing, the average of multiple measured values can be used instead of each measured value. When some data is contaminated or damaged under storage or test, the sample storage of the present invention can provided with the function for a human error backup for amending and recovering based on multiple data matching by reading the same data from lid area and side area. In addition, micro tube 210 may be stored in a sample storage rack 220, controlled and stored by a computer, automatically picked out when it is used in a test, and then transferred to a specified position to use the sample for the test.

While some preferable embodiments of the sample storage according to the present invention are described above, it should be understood that various changes are possible, without deviating from the technical scope according to the present invention. Therefore, the technical scope according to the present invention is limited only by the claims attached.

INDUSTRIAL APPLICABILITY

A sample storage according to the present invention can be used extensively for storing a large number of samples. For example, it can be used as a sample storage for enclosing and storing drug samples. Also, it can be used as a sample storage for storing such samples that hold gene information of DNA in the medical field.

The invention claimed is:

1. A lid element array including a plurality of lid elements for sealing the opening of a plurality of micro tubes comprising;

a lid element sheet wherein a plurality of said lid elements are arrayed corresponding to the number and the arrangement of a plurality of said micro tubes arrayed in said micro tube array;

a release sheet adhered to and supporting said lid element sheet from a side of the lid element sheet opposite that for sealing the micro tubes;

a first adhesive applied at least to a predetermined area of said each lid element in said lid element sheet;

each said lid element in said lid element sheet is supported by said release sheet where a cut-line cut around the edge of each said lid element allows for separation of said lid element from said lid element sheet, each said lid element moves to a corresponding opening of each said micro tube and seals the same by pressing the surface of the lid element sheet with the first adhesive to the surface of the openings of said micro tubes in the array.

2. A lid element array according to claim 1, in which some or all said lid elements comprise a convex portion on the surface, said convex portion works as a positioning guide for each said lid element and each said micro tube by inserting said convex portion to a corresponding opening of said micro tube when pressing said lid element array to said micro tube array.

3. A lid element array according to claim 1, in which said lid element sheet comprises a fitting object fit to the shape of said micro tube on the surface except for the area of said lid element, said fitting object works as a positioning guide for each said lid element and each said micro tube by fitting said fitting object and said shape of said micro tube when pressing said lid element array to said micro tube array.

4. A lid element array according to claim 2, wherein said convex portion of said lid element is a space between said lid element and said release sheet made by an embossing process, and the air in said convex portion works as a shock absorber and a heat absorber for an outer force and heat.

5. A lid element array according to claim 4, wherein a vent hole is provided for said space in said convex portion between said lid element and said release sheet, air goes through said vent hole when an air volume change occurs due to heat transmission or outer force transmission or air pressure change.

6. A lid element array according to claim 4, wherein the area where said convex portion is installed is the center area part of said lid element, the release sheet is adhered to the outer margin area where said convex portion is not formed, and the release sheet is not adhered to said center area.

7. A lid element array according to claim 2, wherein the area where said convex portion is installed is the center area part of said lid element, said first adhesive is applied to the outer margin area except for said center area part where said convex portion is formed.

8. A lid element array according to claim 1, wherein said lid element is made of a foil sheet.

9. A lid element array according to claim 1, wherein said lid element is made of a plastic sheet.

10. A lid element array according to claim 1, wherein the structure of said lid element is a structure in which plural sheets are combined.

11. A lid element array according to claim 1, wherein identification code information is carried onto the surface facing said release sheet of said lid element array, said identification code information turns to be on the top surface of said micro tube sealed by said lid element, and each said micro tube can be identified independently by utilizing said identification code information.

12. A micro tube array set including a micro tube array in which a plurality of micro tubes are arrayed and a lid element array for sealing the opening of a plurality of micro tubes comprising;

a plurality of independent micro tubes;

a storage rack for arraying a plurality of said micro tubes;

a lid element array including a plurality of lid elements for sealing the opening of a plurality of micro tubes comprising; a lid element sheet wherein a plurality of said lid elements are arrayed corresponding to the number and the arrangement of a plurality of said micro tubes arrayed in said micro tube array; a release sheet adhered to and supporting said lid element sheet from a side of the lid element sheet opposite that for sealing the micro tubes; a first adhesive applied at least to a predetermined area of said each lid element in said lid element sheet; wherein, each said lid element in said lid element sheet is supported by said release sheet where a cut-line cut around the edge of each said lid element allows for separation of said lid element from said lid element sheet, each said lid element moves to a corresponding opening of each said micro tube and seals the same by pressing the surface of the lid element sheet with the first adhesive to the surface of the openings of said micro tubes in the array.

13. A micro tube array set according to claim 12, wherein identification code information is carried on the surface of said lid element array facing said release sheet, said identification code information then being on the top surface of said micro tube sealed by said lid element, and each said micro tube can be identified independently by utilizing said identification code information.

* * * * *